US010479633B2

(12) United States Patent
Kawajiri et al.

(10) Patent No.: US 10,479,633 B2
(45) **Date of Patent: *Nov. 19, 2019**

(54) WINDING DEVICE ATTACHABLE TO A PRINTING DEVICE

(71) Applicant: SEIKO EPSON CORPORATION, Tokyo (JP)

(72) Inventors: Masahiro Kawajiri, Shoijiri (JP); Toru Takami, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/107,376

(22) Filed: Aug. 21, 2018

(65) Prior Publication Data

US 2018/0354735 A1 Dec. 13, 2018

Related U.S. Application Data

(63) Continuation of application No. 15/237,057, filed on Aug. 15, 2016, now Pat. No. 10,093,501, which is a (Continued)

(30) Foreign Application Priority Data

Dec. 21, 2003 (JP) ..... 2013-263490
Dec. 19, 2013 (JP) ..... 2013-262877

(51) Int. Cl.
*B65H 18/10* (2006.01)
*B65H 23/195* (2006.01)
(Continued)

(52) U.S. Cl.
CPC ..... *B65H 18/10* (2013.01); *B65H 23/195* (2013.01); *B65H 54/585* (2013.01); *B65H 75/22* (2013.01);
(Continued)

(58) Field of Classification Search
CPC ..... B65H 18/10; B65H 75/22; B65H 75/241; B65H 54/585; B65H 23/195;
(Continued)

(56) References Cited

U.S. PATENT DOCUMENTS 6,439,786 B1 8/2002 Hasiuk
6,735,403 B2 5/2004 Kanno et al.
(Continued)

FOREIGN PATENT DOCUMENTS

CN 102205747 A 10/2011
JP S62-121166 A 6/1987
(Continued)

*Primary Examiner* — Bradley W Thies
(74) *Attorney, Agent, or Firm* — Foley & Lardner LLP

(57) ABSTRACT

A winding device includes a winding shaft that rotates and winds a print medium conveyed from a printing device having a conveyance roller that conveys the print medium, a gear, and a motor driving the conveyance roller and the gear. The winding device also includes a power transfer mechanism to connect to the gear and transfer power to the motor, and a lever disposed between the winding shaft and the conveyance roller in a conveyance path in a configuration in which the winding device is connected to the printing device. The lever may be moved between a first position in which the print medium bends and a second position in which the print medium bends at a shallower angle than at the first position.

9 Claims, 15 Drawing Sheets

Related U.S. Application Data continuation of application No. 14/561,558, filed on Dec. 5, 2014, now Pat. No. 9,440,813.

(51) Int. Cl.

| | |
|---|---|
| ***B65H 54/58*** | (2006.01) |
| ***B65H 75/22*** | (2006.01) |
| ***B65H 75/24*** | (2006.01) |

(52) U.S. Cl.

CPC . *B65H 75/241* (2013.01); *B65H 2301/41368* (2013.01); *B65H 2403/42* (2013.01); *B65H 2403/47* (2013.01); *B65H 2403/732* (2013.01); *B65H 2701/194* (2013.01); *B65H 2801/12* (2013.01)

(58) Field of Classification Search

CPC ..... B65H 2701/194; B65H 2403/42; B65H 2801/12; B65H 2403/47; B65H 2301/41365; B65H 2403/732

See application file for complete search history.

(56) References Cited

U.S. PATENT DOCUMENTS

| | | | |
|---|---|---|---|
| 9,440,813 | B2 | 9/2016 | Kawajiri et al. |
| 2007/0079713 | A1 | 4/2007 | Koeda et al. |
| 2009/0047052 | A1 | 2/2009 | Koyabu |
| 2009/0255971 | A1 | 10/2009 | Nakamaki et al. |
| 2011/0229241 | A1 | 9/2011 | Takahashi |
| 2012/0308289 | A1 | 12/2012 | Kosuge |
| 2013/0001854 | A1 | 1/2013 | Ukai et al. |
| 2015/0091966 | A1 | 4/2015 | Nagaoka |

FOREIGN PATENT DOCUMENTS

| | | | |
|---|---|---|---|
| JP | H01-004657 | U | 1/1989 |
| JP | H07-042700 | U | 8/1995 |
| JP | 11-091993 | A | 4/1999 |
| JP | 2003-261121 | A | 9/2003 |
| JP | 2006-151652 | A | 6/2006 |
| JP | 2006-151653 | A | 6/2006 |
| JP | 2006-321611 | A | 11/2006 |
| JP | 2009-203014 | A | 9/2009 |
| JP | 2012-201491 | A | 10/2012 |
| JP | 2013-011747 | A | 1/2013 |
| JP | 2013-234707 | A | 11/2013 |
| WO | WO-2009-107291 | A1 | 9/2009 |

WINDING DEVICE ATTACHABLE TO A PRINTING DEVICE

CROSS-REFERENCE TO RELATED APPLICATIONS

This application is a continuation of U.S. application Ser. No. 15/237,057, filed Aug. 15, 2016; which is a continuation of U.S. application Ser. No. 14/561,558, filed Dec. 5, 2014; which claims the benefit of priority to Japanese Appl. No. 2013-263490, filed Dec. 20, 2013 and Japanese Appl. No. 2013-262877, filed Dec. 19, 2013; the contents of all of which are incorporated by reference herein in their entirety.

BACKGROUND

1. Technical Field

The present invention relates to a winding device that winds print media conveyed from a printer into a roll, and to a print winding system.

2. Related Art

A winding device according to the related art has a winding shaft (winding unit) onto which continuous label media conveyed from a printer is wound, a motor that drives the winding shaft, a guide roller and an auxiliary roller that guide the continuous label media conveyed from the printer, a swing roller that contacts the continuous label media between the guide roller and the auxiliary roller and absorbs slack in the continuous label media, a roller position sensor that detects the position of the swing roller, and a control unit that determines if winding the continuous label media is completed based on the detection result from the roller position sensor as described in JP-A-2012-201491.

A stationary flange, a removable flange, and a winding core to which the leading end of the continuous label media is affixed with adhesive are installed to the winding unit.

Unlike in a conventional winding device, when the amount of print medium wound onto the winding shaft, or more specifically the diameter of the take-up roll, becomes large in a winding device to which drive power is input from the conveyance unit of the printer, the winding speed becomes slower than the conveyance speed of the print medium when winding starts due to the inertia (inertial moment) of the take-up roll and slack develops in the print medium even if the winding speed at which the print medium is wound onto the winding shaft is designed to be substantially the same as the conveyance speed of the print medium in the printer.

This slack in the print medium then gradually disappears as a result of the winding speed gradually increasing and then temporarily exceeding the media conveyance speed. The moment the slack in the print medium is eliminated, the rotational energy of the take-up roll is transmitted directly to the print medium. More specifically, the print medium is pulled toward the winding device by the rotational energy of the take-up roll. As a result, there is an adverse effect on the conveyance precision of the print medium in the printer.

If the user wraps the leading end of the print medium around the winding shaft to rewind the print medium instead of using a winding core as described above, the position of the second flange in the axial direction of the winding shaft is determined by lightly pushing the second flange against the side edge of the print medium when installing the second flange to the winding shaft. This results in crushing the print medium to some degree in the axial direction. In addition, because the gap between the inside surface of the first flange and the inside surface of the second flange is narrower than the width of the print medium, the print medium is also crushed widthwise as it is wound onto the winding shaft. If the print medium is crushed widthwise, gaps develop between successive layers of the print medium wound onto the winding shaft, which contributes to bagginess.

SUMMARY

An objective of the present invention is to provide a winding device and a print winding system that suppress adverse effects on the conveyance precision of the print medium in a printer, and reduce bagginess.

A winding device according to one aspect of the invention includes a winding shaft that rotates and winds a print medium conveyed from a printing device having a conveyance roller that conveys the print medium, a gear, and a motor driving the conveyance roller and the gear. The winding device also includes a power transfer mechanism to connect to the gear and transfer power to the motor; and a lever disposed between the winding shaft and the conveyance roller in a conveyance path in a configuration in which the winding device is connected to the printing device. The lever is configured to move between a first position in which the print medium bends and a second position in which the print medium bends at a shallower angle than at the first position.

Thus comprised, when the winding speed gradually increases and temporarily exceeds the conveyance speed when winding starts, the lever around which the print medium travels moves from the first position to the second position in resistance to the force pushing the lever to the first position. The rotational energy of the take-up roll is then converted to energy causing the lever to move from the first position to the second position. More specifically, the rotational energy of the take-up roll is absorbed by the lever moving from the first position to the second position. As a result, the rotational energy of the take-up roll pulling the print medium to the winding device side is suppressed. Therefore, adverse effects on the conveyance precision of the print medium in the printing device can be prevented.

In another aspect of the invention, the power transfer mechanism includes an input gear that is connected to the gear, the input gear being configured to move relative to the gear.

Further preferably, the first position is lower than the second position.

Thus comprised, gravity works as the force moving the lever to the first position. More specifically, the rotational energy of the take-up roll is converted to the potential energy of the lever. A spring or other member is therefore not needed as a means for applying force in the direction of the first position to the lever.

Further preferably, the winding device also has an elastic member that the lever contacts near the second position.

Thus comprised, the elastic member deforms elastically as a result of the lever approaching the second position contacting the elastic member. As a result, the rotational energy of the take-up roll can be absorbed by the elastic member even when the rotational energy of the take-up roll cannot be sufficiently absorbed by the lever simply moving from the first position to near the second position. The print medium can therefore be more reliably prevented from being pulled to the winding device side by the rotational energy of the take-up roll.

Further preferably, the power input unit includes an input gear that meshes with an output gear of the conveyance unit, and a gear support member that rotatably supports the input gear; and a positioning control unit that limits the proximity of the input gear to the output gear is disposed to the gear support member.

Thus comprised, the input gear can be prevented from getting too close to the output gear when the winding device is installed to the printing device. The input gear and the output gear can therefore mesh desirably.

Further preferably, the power input unit is inserted to an input unit insertion recess disposed to the printing device; and an input support unit rockably supports the power input unit on the printing device side.

When the user moves the winding device at an angle to the direction in which the power input unit leaves the input unit insertion recess of the printing device while removing the winding device from the printing device, the power input unit may catch on the top edge part of the input unit insertion recess. However, because the power input unit can rock relative to the input support unit in this configuration, the power input unit can be pulled smoothly out from the input unit insertion recess.

Further preferably in this configuration, the lever has a roller.

Thus comprised, friction with the conveyed print medium causes the roller to rotate following the print medium. The lever rubbing against the printing surface of the print medium can therefore be suppressed.

Further preferably in this configuration, the roller includes a plurality of roller segments distributed in the axial direction.

This configuration reduces the contact area between the lever and the printing surface of the print medium, and can more effectively prevent the lever from rubbing against the printing surface of the print medium.

Yet further preferably, the lever further has a roller lever that supports the lever and can rotate on a pivot point.

Thus comprised, the lever can move rotationally between the first position and the second position on the pivot point of the rotating roller lever.

Further preferably in this configuration, the power transfer mechanism has a torque limiter.

Thus comprised, the torque limiter can absorb the speed difference of the conveyance speed of the print medium in the printing device, and the winding speed at which the print medium is taken up by the winding shaft.

Another aspect of the invention is a winding device including: a winding shaft on which a print medium conveyed from a printing device is wound; a first flange disposed to the winding shaft; and a second flange removably disposed to the winding shaft. An annular rib is also disposed protruding from the outside perimeter of the inside circumference edge part of the inside surface of at least one of the first flange and the second flange.

Thus comprised, the gap between the inside surface of the first flange and the inside surface of the second flange is greater in the area outside the inside circumference edge where the annular rib is disposed. As a result, even if the print medium is crushed widthwise between the annular rib of one flange and the other flange by pushing the second flange lightly against the side of the print medium when the user installs the second flange to the winding shaft, the widthwise crushing of the print medium disappears when the print medium wound onto the winding shaft, specifically when the diameter of take-up roll, becomes greater than the outside diameter of the annular rib. After the widthwise crushing of the print medium disappears, the print medium can be wound stably. Bagginess can therefore be reduced.

Note that the first flange may be fixed on the winding shaft or removably installed to the winding shaft. The annular rib may also be continuous in the circumferential direction, or not continuous in the circumferential direction.

Yet further preferably, the protruding height of the annular rib is greater than or equal to 0.3 mm and less than or equal to 1.0 mm.

If the protruding height of the annular rib is 0.3 mm or greater, widthwise crushing of the print medium can be effectively eliminated when the diameter of the take-up roll becomes greater than the diameter of the annular rib. Furthermore, if the protruding height of the annular rib is less than or equal to 1.0 mm, the print medium can be rewound with the sides of the print medium reliably guided by the first flange and second flange even after the diameter of the take-up roll becomes greater than the diameter of the annular rib.

Further preferably, the difference between the outside circumference radius and the inside circumference radius of the annular rib is greater than or equal to 3 mm and less than or equal to 5 mm.

If the difference between the outside circumference radius and the inside circumference radius of the annular rib is at least 3 mm, the print medium can be held between the annular rib of the one flange and the other flange even when the user wraps the leading end of the print medium relatively loosely on the winding shaft.

If the difference between the outside circumference radius and the inside circumference radius of the annular rib is less than or equal to 5 mm, widthwise crushing of the print medium can be eliminated soon after winding starts.

Further preferably, inside diameter of the annular rib is greater than or equal to 70 mm and less than or equal to 90 mm.

Yet further preferably, the winding device has an engaging part that engages an engaging post disposed to the printing device.

Thus comprised, the winding device can be desirably positioned and installed to the printing device by engaging the engaging part with the engaging post. Bagginess resulting from the winding device being installed at an offset position to the printing device can therefore be prevented.

Further preferably, the engaging part has an engagement receiving part that the engaging post enters; and a hook member that moves between a locked position locking the engaging post in the engagement receiving part, and an unlocked position allowing the engaging post to leave the engagement receiving part.

Thus comprised, by locking the engaging post inserted to the engagement receiving part with the hook member, the engaging part and the engagement receiving part can be held reliably engaged.

Yet further preferably, the winding device also has an indexing mark that indicates whether or not the hook member is in the locked position.

Thus comprised, when the engaging post is disposed to the bottom of the printing device, for example, and the engaging part is hidden by the printing device when the engaging post is in the engagement receiving part, it is difficult for the user to visually confirm if the hook member is in the locked position. However, by providing an indexing mark, the user can easily check whether or not the hook member is in the locked position.

Further preferably, the winding device has ratchet teeth disposed on the outside surface of the winding shaft along the axial direction of the winding shaft; and a flange attachment lever having a ratchet claw that engages the ratchet teeth, and is disposed to the second flange enabling the ratchet claw to engage and disengage the ratchet teeth. The ratchet teeth and the ratchet claw allow the second flange to slide in the direction approaching, and prevent sliding in the direction away from, the first flange.

When installing the second flange to the winding shaft in this configuration, the user can slide the second flange toward the first flange while feeling the positive clicks of the ratchet teeth and the ratchet claw engaging. As a result, the user can slide the first flange in incremental steps to the desired position instead of in one sudden action. Excessive crushing of the print medium that can result in bagginess can therefore be prevented.

Another aspect of the invention is a print winding system including: the winding device of the invention, and a printing device.

By using a winding device that suppresses adverse effects on the conveyance precision of the print medium in the printing device, printed images that are desirably printed can be achieved.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a print winding system according to the present invention is described below with reference to the accompanying figures. The print winding system in this embodiment of the invention includes a printing device (printer) that prints images by an inkjet method on roll paper or other continuous print medium, and a winding device that rewinds the printed print medium conveyed from the printer.

Note that the invention is described using the directions top, bottom, left, right, front, and rear as shown in the figures, but these directions are for descriptive convenience only, and the invention is obviously not limited to these directions.

Figure 1:
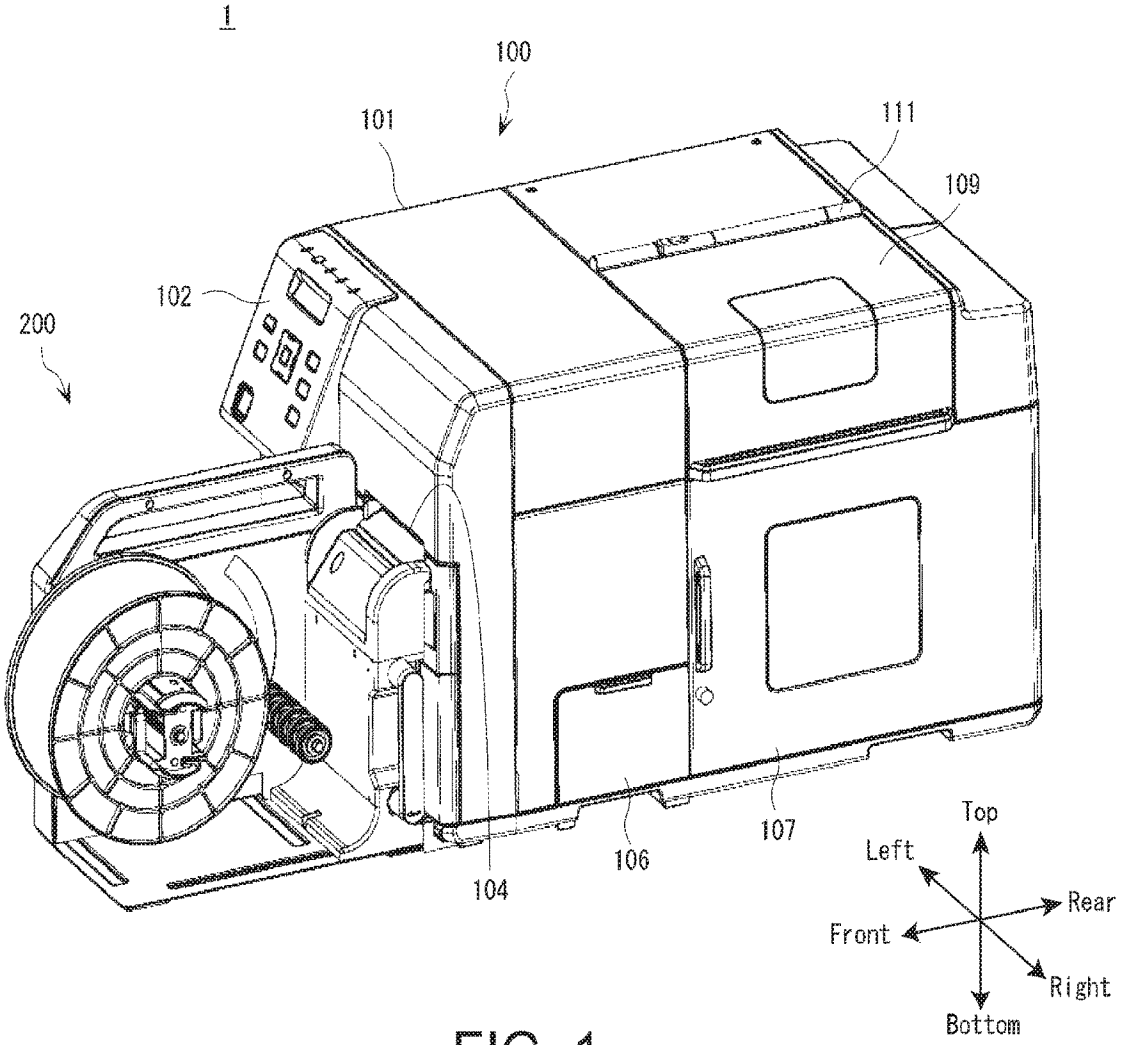
FIG. 1 is an external oblique view of a print winding system according to an embodiment of the invention.
Figure 2:
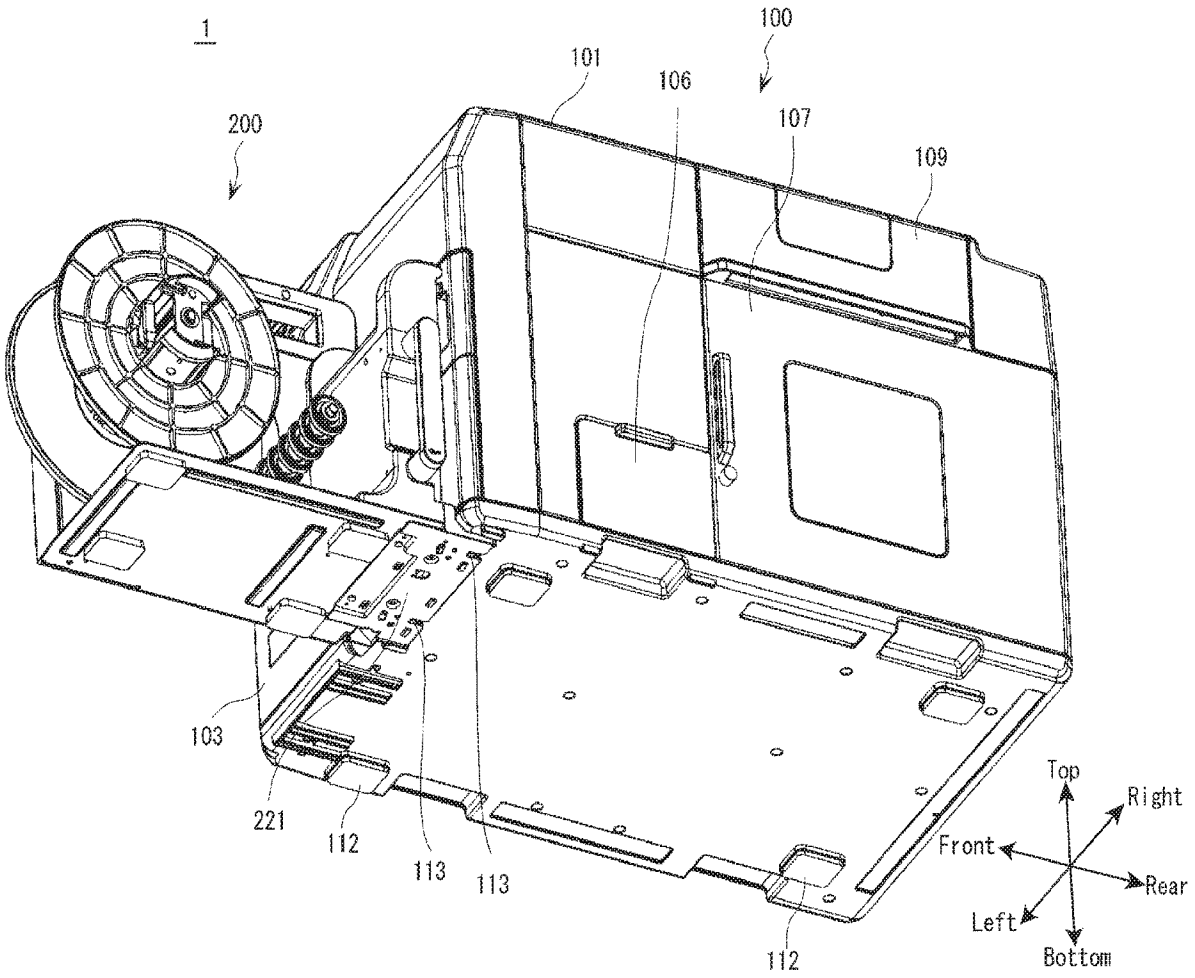
FIG. 2 is an external oblique view of a print winding system according to an embodiment of the invention from a different angle than in FIG. 1.

As shown in FIG. 1 and FIG. 2, the print winding system 1 according to this embodiment of the invention includes a printer (printing device) 100, and a winding device 200 disposed in front of the printer 100.

The printer 100 is described first below.

Figure 3:
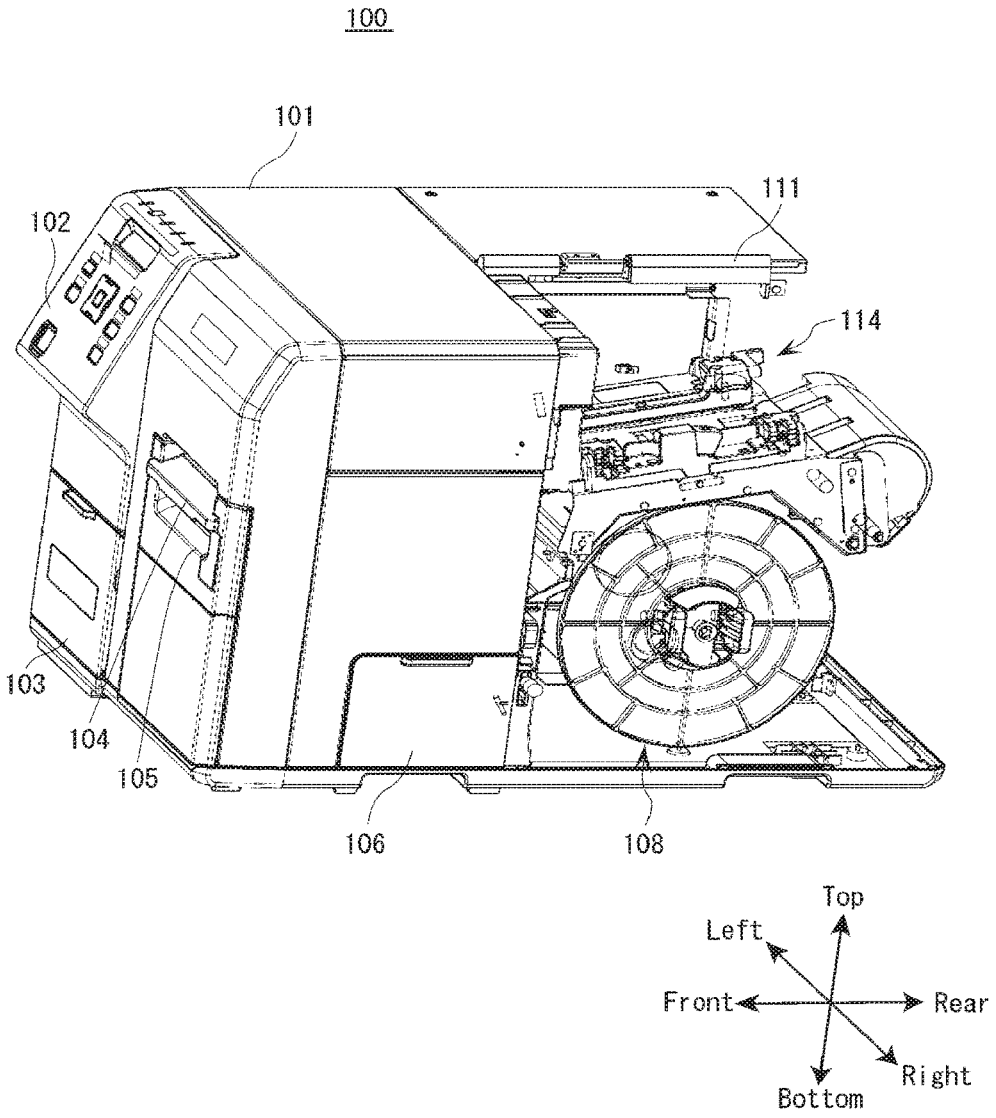
FIG. 3 is an external oblique view of a printing device with part of the inside exposed.

As shown in FIG. 1 to FIG. 3, the printer 100 has a basically rectangular box-like case 101. A display and operating panel 102 populated with a display and operating buttons is disposed at the top left part of the front of the case 101. Below the display and operating panel 102 is an ink cartridge replacement opening 103. A paper exit 104 that is long from left to right is disposed in the middle of the right side of the front of the case 101. Printed roll paper S (see FIG. 15) is discharged toward the winding device 200 from the paper exit 104. Below the paper exit 104 is a basically rectangular input unit insertion recess 105. The power input unit 206 (described further below) of the winding device 200 is inserted from the front to the right end part of the input unit insertion recess 105.

A waste ink replacement opening 106 is disposed on the right side of the case 101. A large roll paper supply opening 107 is disposed from the back of the waste ink replacement opening 106 to the back of the case 101. A roll paper loading unit 108 is disposed inside the roll paper supply opening 107. The user loads roll paper S that is wound into a roll from the roll paper supply opening 107 to the roll paper loading unit 108.

An outside cover 109 that opens and closes the inside of the printer is disposed to the case 101 from the top of the roll paper supply opening 107 to the top of the case 101. The outside cover 109 pivots on a hinge 111 disposed substantially in the middle of the top of the case 101.

Thick, substantially rectangular feet 112 are attached at the four corners of the bottom of the case 101. Two engaging posts 113 are disposed side by side on the front right side part of the bottom of the case 101 (see FIG. 2). The engaging posts 113 are formed as substantially cylindrical protrusions. The two engaging posts 113 engage two engaging parts 230 described below.

As shown in FIG. 3, the printer 100 includes the roll paper loading unit 108, a guide unit 114 disposed above the roll paper loading unit 108, a conveyance unit 115 (see FIG. 4) that feeds the roll paper S from the roll paper loading unit 108, a print unit (not shown in the figure) disposed in front of the guide unit 114, and a control unit (not shown in the figure) that centrally controls these other parts.

The roll paper S delivered from the roll paper loading unit 108 is conveyed while guided by the guide unit 114, printed on by the print unit with an inkjet head, and then discharged from the paper exit 104.

The conveyance unit 115 includes a paper feed motor 116 (see FIG. 4) as the drive source, and a conveyance roller to which power from the paper feed motor 116 is input through a gear train not shown. The conveyance roller is disposed between the guide unit 114 and the print unit, and rotationally feeds the roll paper S.

Figure 4:
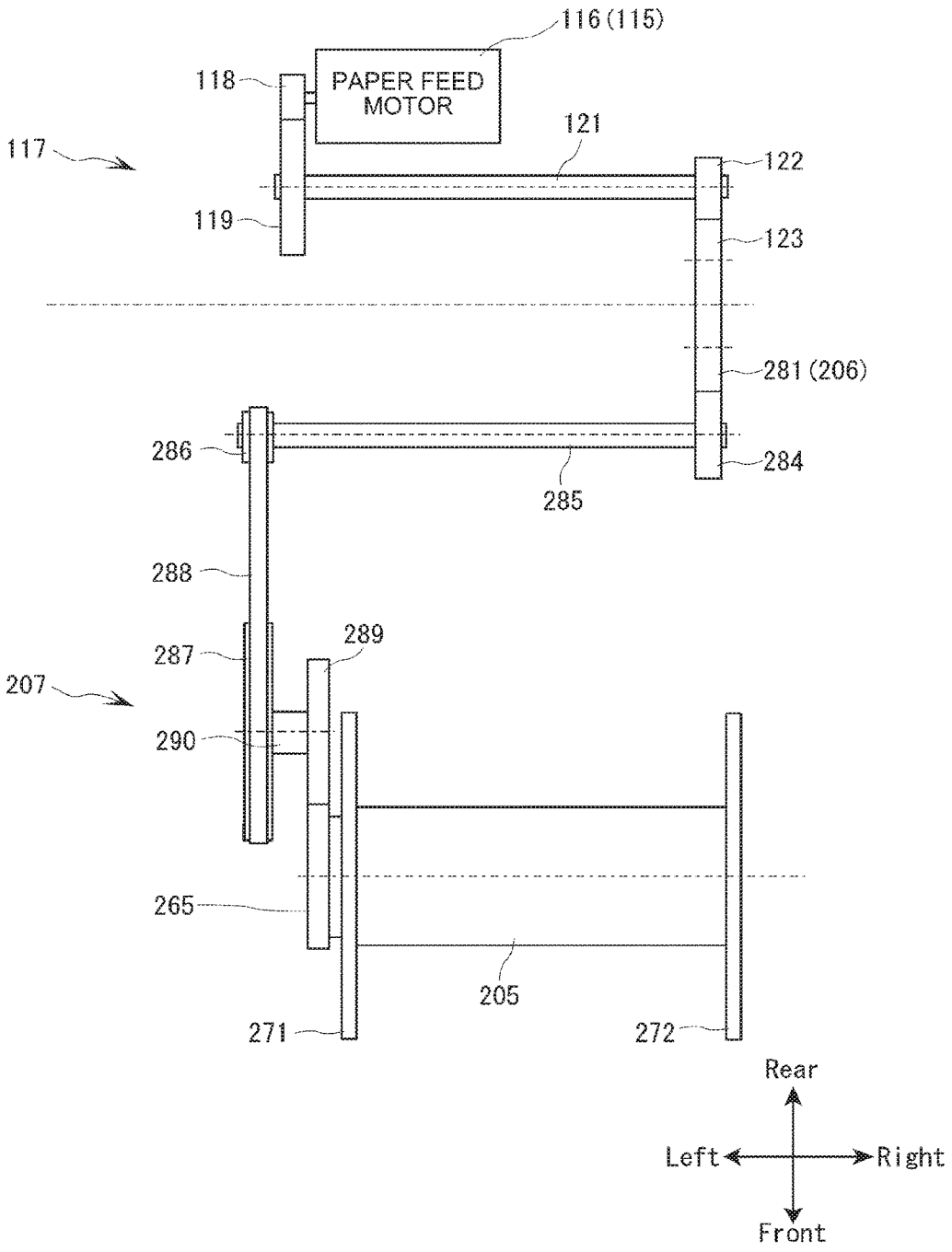
FIG. 4 illustrates the configuration of the printer-side power transfer mechanism and the winder-side power transfer mechanism.

As shown in FIG. 4, power from the paper feed motor 116 is transferred through a printer-side power transfer mechanism 117 to the winding device 200 side. The printer-side power transfer mechanism 117 includes a small gear 118 coupled to the output shaft of the paper feed motor 116, a printer-side first intermediate gear 119 that meshes with the small gear 118, a printer-side shaft 121, a printer-side second intermediate gear 122 coupled with the printer-side first intermediate gear 119 through the printer-side shaft 121, and an output gear 123 that meshes with the printer-side second intermediate gear 122. The output gear 123 also meshes with the input gear 281 described below of the winding device 200.

Figure 5:
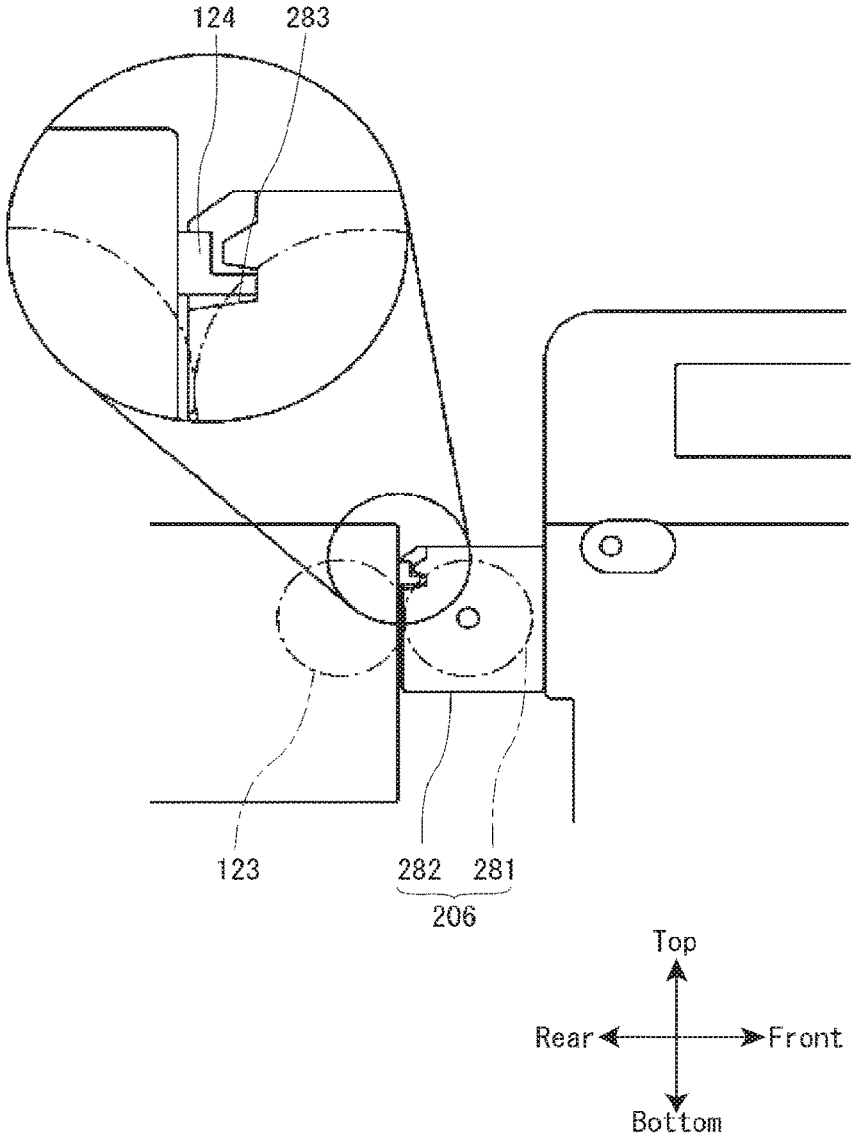
FIG. 5 illustrates the area around the power input unit of the winding device.

As shown in FIG. 5, a printer-side engaging part 124 that is substantially L-shaped when seen from the left side is formed protruding from the right inside part of the input unit insertion recess 105. The printer-side engaging part 124 engages a winder-side engaging part 283 (described further below) of the winding device 200.

The winding device 200 is described next.

As shown in FIG. 6 to FIG. 9, the winding device 200 has a flat, substantially rectangular base plate 201; a flat, box-shaped winding support unit 202 disposed vertically on the left side of the base plate 201; and a roll paper loading stand 203 disposed vertically to the back side, that is, on the printer 100 side, part of the base plate 201.

The winding device 200 includes a positioning mechanism 204 (see FIG. 10 and FIG. 11) disposed to the roll paper loading stand 203; a substantially cylindrical winding shaft 205 supported cantilevered from the right side of the winding support unit 202; a power input unit 206 disposed at the right top part of the back of the roll paper loading stand 203; a winder-side power transfer mechanism 207 (see FIG. 4) assembled to the roll paper loading stand 203 and winding support unit 202; and a lever 208 disposed between the roll paper loading stand 203 and the winding shaft 205.

The winding support unit 202 has an inside wall 211 on the right side and an outside wall 212 on the left side. A curved roller travel slot 213 is formed in the inside wall 211. A handle 214 is disposed to the top of the winding support unit 202. The user can hold the handle 214 to carry the winding device 200. Guide units 215 for guiding the roll paper S conveyed from the printer 100 are disposed to the top left and right ends of the roll paper loading stand 203. The surface between the guide units 215 slopes down to the inside.

The roll paper S is conveyed with the printed side up from the printer 100. The roll paper S conveyed from the printer 100 travels from the roll paper loading stand 203 past the lever 208 to the winding shaft 205 through a conveyance path that is basically V-shaped when seen from the right side (see FIG. 15).

The positioning mechanism 204 is for determining the installation position of the winding device 200 to the printer 100.

Figure 10:
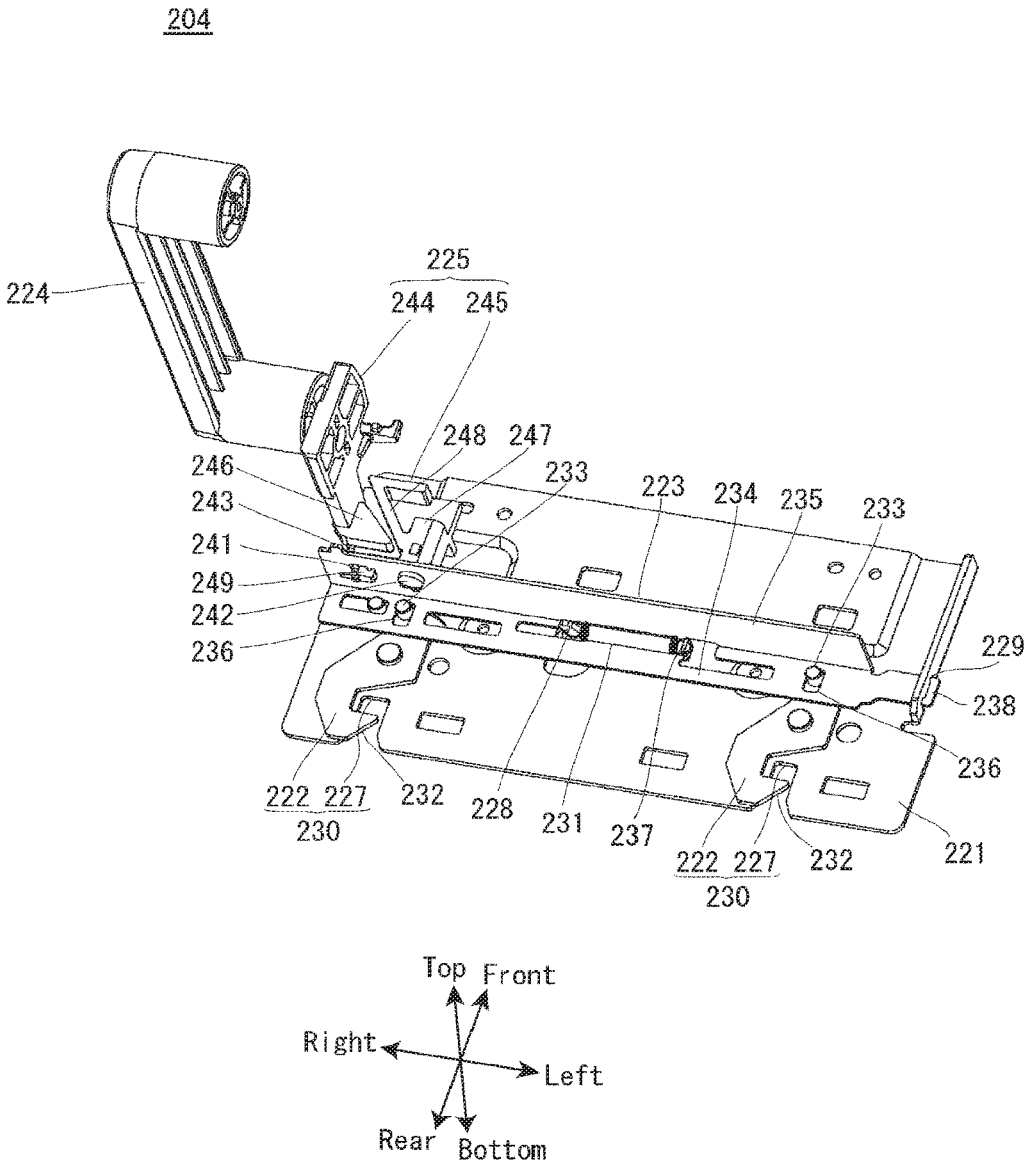
FIG. 10 is an oblique view of the positioning mechanism.
Figure 11:
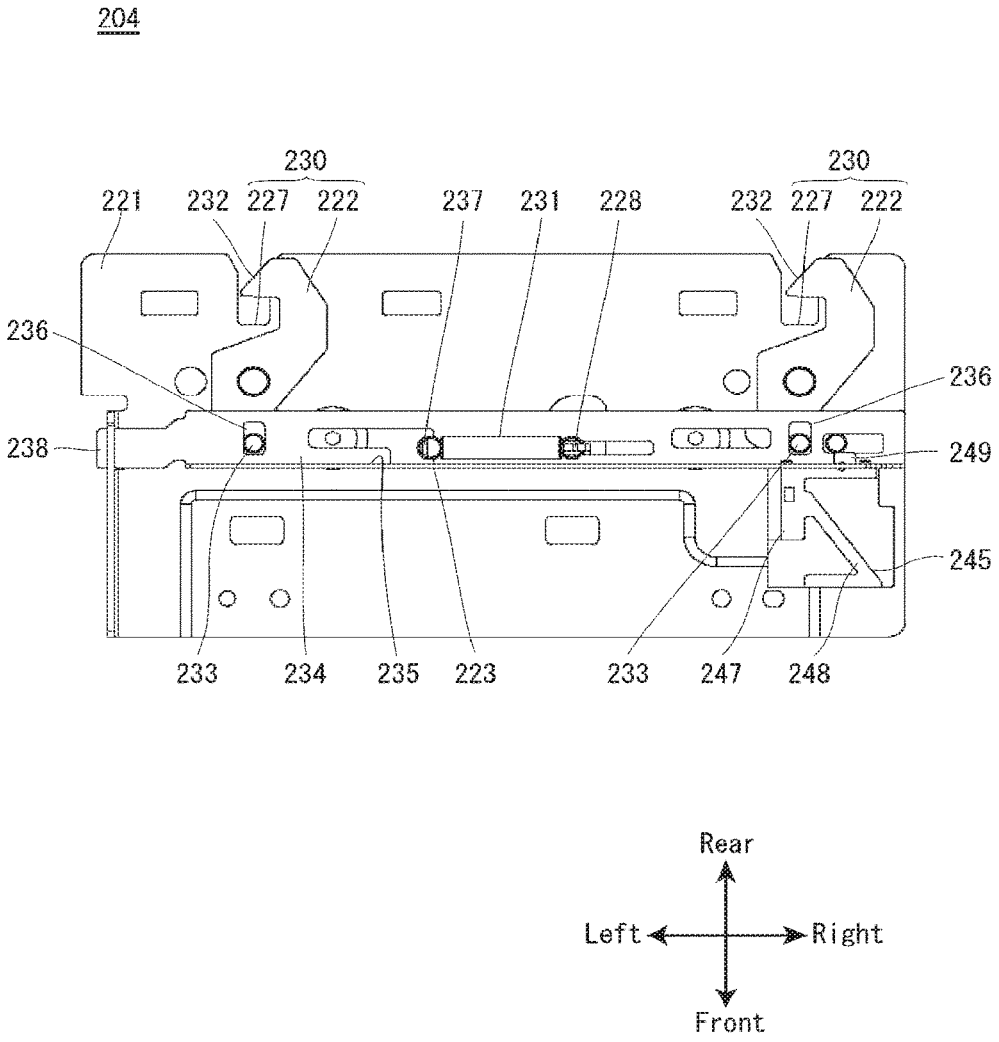
FIG. 11 is a plan view of the positioning mechanism.

As shown in FIG. 10 and FIG. 11, the positioning mechanism 204 has a positioning plate 221 (see FIG. 2) disposed at the back end part of the base plate 201; two hooks 222 pivotably supported on the positioning plate 221; a slide member 223 supported on top of the positioning plate 221; a positioning spring 231 that urges the slide member 223 to the right; a lock release handle 224 (see FIG. 6) disposed on the right side of the roll paper loading stand 203; a linkage mechanism 225 that connects the lock release handle 224 and the slide member 223; and a positioning cover 226 (see FIG. 6) disposed at the bottom back end part of the roll paper loading stand 203.

The positioning plate 221 is a substantially rectangular plate. Two notches 227 are formed on the left and right sides at the rear side of the positioning plate 221. The two engaging posts 113 described above fit into these two notches 227. The notches 227 are basically rectangular and widen to the outside edge. A spring catch 228 protrudes from substantially the middle of the positioning plate 221. The right end of the positioning spring 231 is caught on the spring catch 228. A guide insertion hole 229 in which the guide tab 238 described below fits is disposed to the left end of the positioning plate 221.

The hooks 222 are supported at approximately the middle thereof pivotably on the positioning plate 221. The hooks 222 can pivot between a locked position locking the engaging posts 113 in the notches 227, and an unlocked position allowing the engaging posts 113 to leave the notches 227. More specifically, the hooks 222 pivot from the locked position clockwise as seen from above to the unlocked position. The hooks 222 and notches 227 embody the engaging parts 230.

The hooks 222 are urged by the positioning spring 231 through the slide member 223 to the locked position. A sloped part 232 is formed at the distal end of each hook 222. When the engaging post 113 enters the notch 227, the engaging post 113 pushes against the sloped part 232 of the hook 222 in the locked position, and the hook 222 pivots from the locked position to the unlocked position in resistance to the positioning spring 231. More specifically, the engaging post 113 pushes past the hook 222 closing the entrance to the notch 227, and enters the notch 227. A hook post 233 that engages the slide member 223 protrudes vertically from the base end part of each hook 222.

The slide member 223 is disposed slidably left and right to the positioning plate 221. The slide member 223 is urged to the right by the positioning spring 231. When the slide member 223 slides to the left from the right end in resistance to the positioning spring 231, the hooks 222 rotate to the unlocked position. When the slide member 223 then slides from this position to the right urged by the positioning spring 231, the hooks 222 rotate to the locked position.

The size of the slide member 223 is substantially the same as the positioning plate 221 in the left-right direction, and bends in an L-shape when seen from the right side. The slide member 223 has a hook engaging part 234 disposed substantially parallel to the positioning plate 221, and a linkage engaging part 235 that extends up from the front edge part of the hook engaging part 234.

Hook member engaging holes 236 that engage the hook posts 233 are disposed to the hook engaging part 234 at two, left and right, positions. A spring catch 237 between the two hook member engaging holes 236. The left end of the positioning spring 231 is held by the spring catch 237. The positioning spring 231 is a coil tension spring, and urges the slide member 223 to the right. The guide tab 238 extending left and right is disposed at the left end of the hook engaging part 234. The guide tab 238 inserts to the guide insertion hole 229, and guides the slide member 223 sliding left and right.

A linkage engaging hole 241 and a linkage screw hole (not shown in the figure) are disposed in order from the outside to the right end part of the linkage engaging part 235. A linkage engaging post 249 described below engages the linkage engaging hole 241. A linkage set screw 242 is inserted to the linkage screw hole. An indexing post 243 that is semi-circular when seen from the rear protrudes from the top right end part of the 235.

The lock release handle 224 is basically U-shaped when seen from the rear. The lock release handle 224 can slide between the front and rear. The lock release handle 224 is urged to the rear by a spring not shown.

The linkage mechanism 225 causes the slide member 223 to slide to the left in conjunction with the lock release handle 224 sliding to the front. The linkage mechanism 225 includes a handle-side linkage member 244 disposed to the bottom end of the lock release handle 224, and a plate-side linkage member 245 disposed to the front right end part of the slide member 223.

The handle-side linkage member 244 slides front and rear in conjunction with the lock release handle 224 sliding front and rear. An operating part 246 having a right triangle shape when seen in plan view is disposed to the bottom end part of the handle-side linkage member 244.

The plate-side linkage member 245 slides left and right in unison with the slide member 223.

The plate-side linkage member 245 has an attachment part 247 that is basically L-shaped in plan view, and a receiver part 248 that extends diagonally right to the front from near the front right side of the attachment part 247.

The linkage engaging post 249 protrudes from the rear of the attachment part 247. The linkage engaging post 249 engages the linkage engaging hole 241 described above. The attachment part 247 is fastened by the linkage set screw 242 to the linkage engaging part 235. The receiver part 248 is the part that is pushed by the operating part 246 sliding to the front. The plate-side linkage member 245 slides to the left as a result of the receiver part 248 being pushed to the front by the operating part 246.

When the lock release handle 224 is slid to the front with the linkage mechanism 225 thus comprised, the handle-side linkage member 244 slides toward the front and the operating part 246 pushes the receiver part 248 to the front. As a result, the plate-side linkage member 245 and slide member 223 slide in unison to the left in resistance to the positioning spring 231.

The positioning cover 226 covers the top of the positioning plate 221, hook 222, and slide member 223. An indexing hole 251 (see FIG. 8) that is substantially rectangular and long on the left and right axis is formed in the top right front corner part of the positioning cover 226. An indexing mark 252 that is triangular, for example, (see FIG. 8) is formed in the right end edge part of the indexing hole 251. The user can see the indexing post 243 through the indexing hole 251. The indexing mark 252 is formed to substantially match the position of the indexing post 243 in the left-right direction when the slide member 223 is positioned at the right end.

When installing the winding device 200 to the printer 100 with the positioning mechanism 204 thus comprised, the user slides the winding device 200 toward the printer 100 on the installation surface. As a result, the engaging posts 113 contact the hooks 222, and the hooks 222 rotate from the locked position to the unlocked position in resistance to the positioning spring 231.

The slide member 223 then slides to the left. After the hooks 222 enter the notches 227, the hooks 222 return to the locked position by the positioning spring 231, and the hooks 222 lock the engaging posts 113. At this time the slide member 223 returns to the right end position.

By thus locking the engaging posts 113 in the notches 227 by the hooks 222, the engaging parts 230 and the engaging posts 113 are held reliably engaged. In addition, by engaging the engaging parts 230 with the engaging posts 113, the winding device 200 can be installed to the printer 100 in a desirably positioned state to the printer 100. As a result, bagginess in the roll paper S wound onto the winding shaft 205 due to incorrect positioning of the winding device 200 to the printer 100 can be prevented. More specifically, bagginess can occur when the winding shaft 205 is set to the printer 100 in a position offset to the widthwise (left-right) axis of the roll paper S, but this embodiment of the invention prevents such bagginess because the winding shaft 205 is desirably positioned to the printer 100 widthwise to the roll paper S by engaging the two engaging parts 230 with the two engaging posts 113.

If the engaging posts 113 are not inserted completely to the notches 227, the hooks 222 are prevented by the engaging posts 113 from returning to the locked position, and the engaging parts 230 cannot completely engage the engaging posts 113. Furthermore, because the engaging posts 113 are disposed to the bottom of the printer 100, the engaging parts 230 are covered by the printer 100 when the engaging posts 113 are in the notches 227, and as shown in FIG. 1 it is difficult for the user to directly visually confirm if the hooks 222 are in the locked position, that is, whether or not the engaging posts 113 are desirably locked by the hooks 222.

Because the slide member 223 is returned to the right end position when the hooks 222 return to the locked position in this embodiment of the invention, the user can visually confirm that the indexing post 243 is desirably positioned left and right to the indexing mark 252. Conversely, if the hooks 222 do not return to the locked position, the slide member 223 also does not return to the right position, and the user can visually confirm that the indexing post 243 is positioned to the left of the indexing mark 252. As a result, the user can easily confirm whether or not the hooks 222 are in the locked position. In other words, the user can easily known when the engaging parts 230 and the engaging posts 113 are not completely engaged.

To remove the winding device 200 from the printer 100, the user first slides the lock release handle 224 to the front. In conjunction therewith, the slide member 223 slides to the left in resistance to the positioning spring 231, and the hooks 222 rotate to the unlocked position. As a result, the engaging posts 113 are allowed to leave the notches 227. The user can then easily slide the winding device 200 away from the printer 100 on the installation surface. The winding device 200 can thereby be easily removed from the printer 100.

Power from the paper feed motor 116 of the printer 100 is input to the winding shaft 205 through the printer-side power transfer mechanism 117 and the winder-side power transfer mechanism 207 (see FIG. 4). As a result, the winding shaft 205 turns and the roll paper S is wound by the winding shaft 205.

As shown in FIG. 6 to FIG. 9, the winding shaft 205 is rotatably supported by the winding support unit 202 through an axial support rod 261 passing through the center of the winding shaft 205. Two curved flanges 262 and two trapezoidal recesses 263 are formed in the outside surface of the winding shaft 205. The two curved flanges 262 are mutually symmetrical to the axis, and the two recesses 263 are mutually symmetrical to the axis. Ratchet teeth 264 are formed on the surface of each recess 263 along the axis of the winding shaft 205. A shaft gear 265 that meshes with a winder-side second intermediate gear 289 described below is disposed to the left end of the winding shaft 205 (see FIG. 4).

A first flange 271 fixed to the end on the winding support unit 202 side, and a second flange 272 removably attached to the opposite end, are disposed to the winding shaft 205. A flange attachment lever 273 is disposed to the second flange 272. The roll paper S conveyed from the printer 100 is taken up on the winding shaft 205 while being guided widthwise by the first flange 271 and the second flange 272.

The first flange 271 is basically circular. A basically round first axle hole (not shown in the figure) is formed in the center of the first flange 271. The winding shaft 205 is inserted to this first axle hole. An annular rib 275 that protrudes from around the outside edge is disposed to the inside circumference edge part of the inside surface of the first flange 271, that is, the surface facing the second flange 272. Ribs formed in a spider web pattern extending circumferentially and radially are formed on the outside surface of the first flange 271.

The second flange 272 is also basically circular. A basically round second axle hole (not shown in the figure) is formed in the center of the second flange 272. The winding shaft 205 is also inserted to this second axle hole. The flange attachment lever 273 is disposed to the perimeter of the second flange 272. The inside surface of the second flange 272, that is, the surface facing the first flange 271, is smooth. Like the first flange 271, an annular rib may protrude from around the outside edge of the inside circumference edge part of the inside surface of the second flange 272. Ribs formed in a spider web pattern extending circumferentially and radially are formed on the outside surface of the second flange 272.

Figure 12:
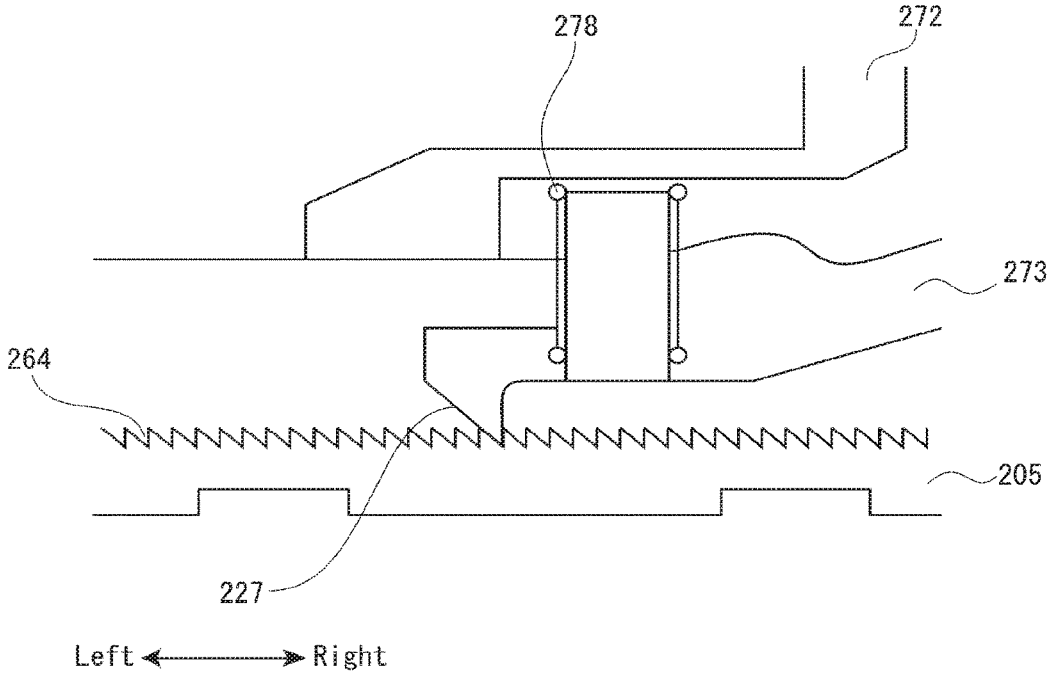
FIG. 12 illustrates the area around the flange installation lever.

As shown in FIG. 12, a ratchet claw 277 that engages the ratchet teeth 264 of the winding shaft 205 is formed on the left end part of the flange attachment lever 273. The ratchet teeth 264 and ratchet claw 277 allow the second flange 272 to slide in the direction toward (to the left), and prevent it from sliding in the direction away from (to the right), the first flange 271. The flange attachment lever 273 is supported in the middle between the left and right ends pivotably between an engaged position where the ratchet claw 277 engages the ratchet teeth 264, and a disengaged position where the ratchet claw 277 is disengaged from the ratchet teeth 264. The flange attachment lever 273 is urged by a flange spring 278 toward the engaged position. A grip 279 (see FIG. 6) for rotating the flange attachment lever 273 to the installation position is formed on the right end of the flange attachment lever 273.

The procedure whereby the user loads the roll paper S on the winding shaft 205 is described next.

First, the user operates the flange attachment lever 273 to remove the second flange 272 from the winding shaft 205. Next, the user wraps the leading end of the roll paper S once or twice around the winding shaft 205. The user then installs the second flange 272 on the winding shaft 205.

Figure 13A:
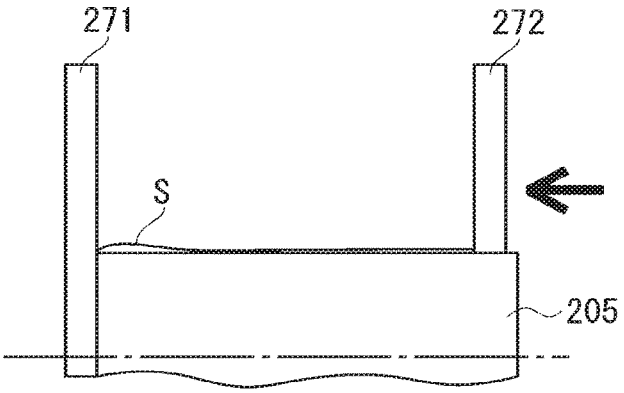
FIGS. 13A and 13B illustrate roll paper wound onto the winding shaft in a winding device according to the related art.
Figure 13B:
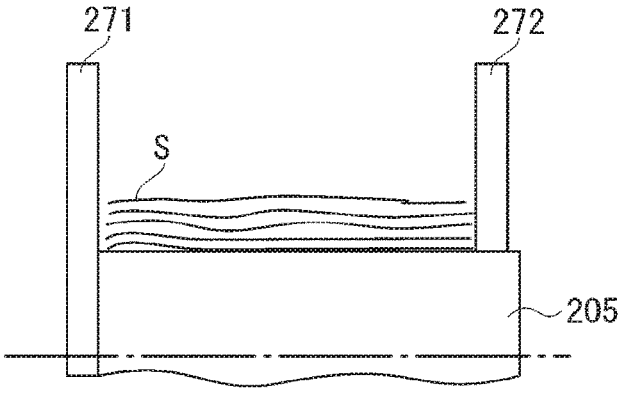
FIG. 13B [Related Art]

As shown in FIG. 13, if the annular rib 275 is not disposed to the first flange 271 as it is in the winding device 200 according to this embodiment, the roll paper S becomes slightly crushed across the width when the second flange 272 is slid toward the first flange 271 until it contacts the right edge of the roll paper S. See FIG. 13A. When this happens, the gap between the inside surface of the first flange 271 and the inside surface of the second flange 272 becomes narrower than the width of the roll paper S at all points in the radial direction, and the roll paper S becomes crushed across the width as the roll paper S is then wound onto the winding shaft 205 as shown in FIG. 13B. When the roll paper S is thus crushed widthwise, gaps are created between the layers of roll paper S wound onto the winding shaft 205, resulting in bagginess.

Figure 14A:
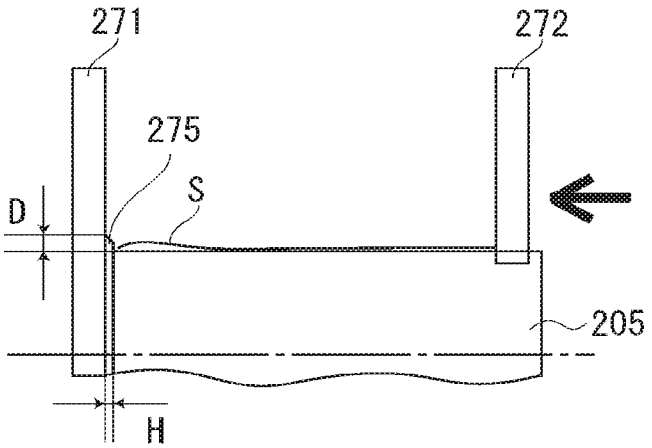
FIGS. 14A and 14B illustrate roll paper wound onto the winding shaft in a winding device according to the invention.
Figure 14B:
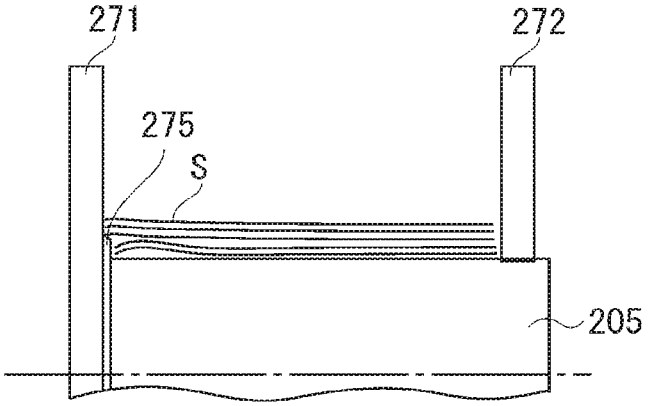

As shown in FIG. 14, the gap between the inside surface of the first flange 271 and the inside surface of the second flange 272 in the winding device 200 according to this embodiment of the invention is greater in the area outside the inside circumference edge where the annular rib 275 is disposed. As a result, even if the roll paper S is crushed widthwise between the annular rib 275 of the first flange 271 and the second flange 272 (as shown in FIG. 14A) by pushing the second flange 272 lightly against the right side of the roll paper S when the user installs the second flange 272 to the winding shaft 205, the widthwise crushing of the roll paper S disappears when the roll paper S wound onto the winding shaft 205, that is, when the diameter of take-up roll R, becomes greater than the outside diameter of the annular rib 275 as shown in FIG. 14B. After the widthwise crushing of the roll paper S disappears, the roll paper S can be wound stably. Bagginess can therefore be reduced.

The protruding height H of the annular rib 275 is preferably at least 0.3 mm and less than or equal to 1.0 mm. If the protruding height H of the annular rib 275 is 0.3 mm or greater, widthwise crushing of the roll paper S can be effectively eliminated when the diameter of the take-up roll R becomes greater than the diameter of the annular rib 275. Furthermore, if the protruding height H of the annular rib 275 is less than or equal to 1.0 mm, the roll paper S can be rewound with the sides of the roll paper S reliably guided by the first flange 271 and second flange 272 even after the diameter of the take-up roll R becomes greater than the diameter of the annular rib 275.

The difference between the outside circumference radius and the inside circumference radius of the annular rib 275 is preferably at least 3 mm and less than or equal to 5 mm. If the difference between the outside circumference radius and the inside circumference radius of the annular rib 275 is at least 3 mm, the roll paper S can be held between the annular rib 275 of the first flange 271 and the second flange 272 even when the user wraps the leading end of the roll paper S relatively loosely on the winding shaft 205. If the difference between the outside circumference radius and the inside circumference radius of the annular rib 275 is less than or equal to 5 mm, widthwise crushing of the roll paper S can be eliminated soon after winding starts.

Furthermore, the inside diameter (diameter of the inside circumference) of the annular rib 275 is not specifically limited, but is preferably at least 70 mm and less than or equal to 90 mm.

When installing the second flange 272 to the winding shaft 205, the user can slide the second flange 272 toward the first flange 271 while feeling the positive clicks of the ratchet teeth 264 and the ratchet claw 277 engaging. As a result, the user can slide the first flange 271 in incremental steps to the desired position instead of in one sudden action. Excessive crushing of the roll paper S that can result in bagginess can therefore be prevented.

Note that the roll paper S can be set on the winding shaft 205 by simply wrapping the leading end of the roll paper S around the winding shaft 205, or by mounting a paper core to which the leading end of the roll paper S is attached by adhesive on the winding shaft 205.

As shown in FIG. 5, the power input unit 206 includes an input gear 281 to which power from the conveyance unit 115 of the printer 100 is input, and a gear support member 282 that rotatably supports the input gear 281.

The gear support member 282 is a flat box-like configuration that is open to the front and rear. The input gear 281 is supported inside the gear support member 282. The gear support member 282 is supported so that the base end part thereof can rock vertically at the printer 100 side of the roll paper loading stand 203.

Note that the roll paper loading stand 203 is an example of the input support unit in the accompanying claims.

When the user moves the winding device 200 at an angle to the direction (from the rear to the front) in which the power input unit 206 leaves the input unit insertion recess 105 of the printer 100 (such as by holding the handle 214 and pulling the winding device 200 up at an angle instead of sliding the winding device 200 along the installation surface) while removing the winding device 200 from the printer 100, the power input unit 206 may catch on the top edge part of the input unit insertion recess 105. However, because the gear support member 282 is supported so that it can rock up and down on the roll paper loading stand 203 in this embodiment of the invention, the gear support member 282 moves down relative to the roll paper loading stand 203 and the power input unit 206 can be pulled smoothly out from the input unit insertion recess 105 even if the power input unit 206 catches on the top edge part of the input unit insertion recess 105. Damage to the input unit insertion recess 105 of the printer 100 and the power input unit 206 of the winding device 200 can therefore be prevented.

The winder-side engaging part 283 is formed as a notch at the rear end part of the left side wall of the gear support member 282, that is, near the top of the end toward the printer 100. The printer-side engaging part 124 engages the winder-side engaging part 283. This controls the distance between the input gear 281 and the output gear 123. As a result, the input gear 281 is prevented from getting too close to the output gear 123 when the winding device 200 is installed to the printer 100. The input gear 281 can therefore be desirably meshed with the output gear 123.

Note that the winder-side engaging part 283 is an example of a positioning control unit in the accompanying claims.

As shown in FIG. 4, the winder-side power transfer mechanism 207 includes a winder-side first intermediate gear 284 that meshes with the input gear 281; a winder-side connecting shaft 285; a small pulley 286 that connects to the winder-side first intermediate gear 284 through the winder-side connecting shaft 285; a large pulley 287; an endless belt 288 mounted on the small pulley 286 and large pulley 287; a winder-side second intermediate gear 289 that meshes with the shaft gear 265; and a torque limiter 290 disposed between the large pulley 287 and the winder-side second intermediate gear 289.

The winder-side first intermediate gear 284 is housed in the right top part of the roll paper loading stand 203. The winder-side connecting shaft 285 extends between the left and right sides of the top of the roll paper loading stand 203.

Figure 7:
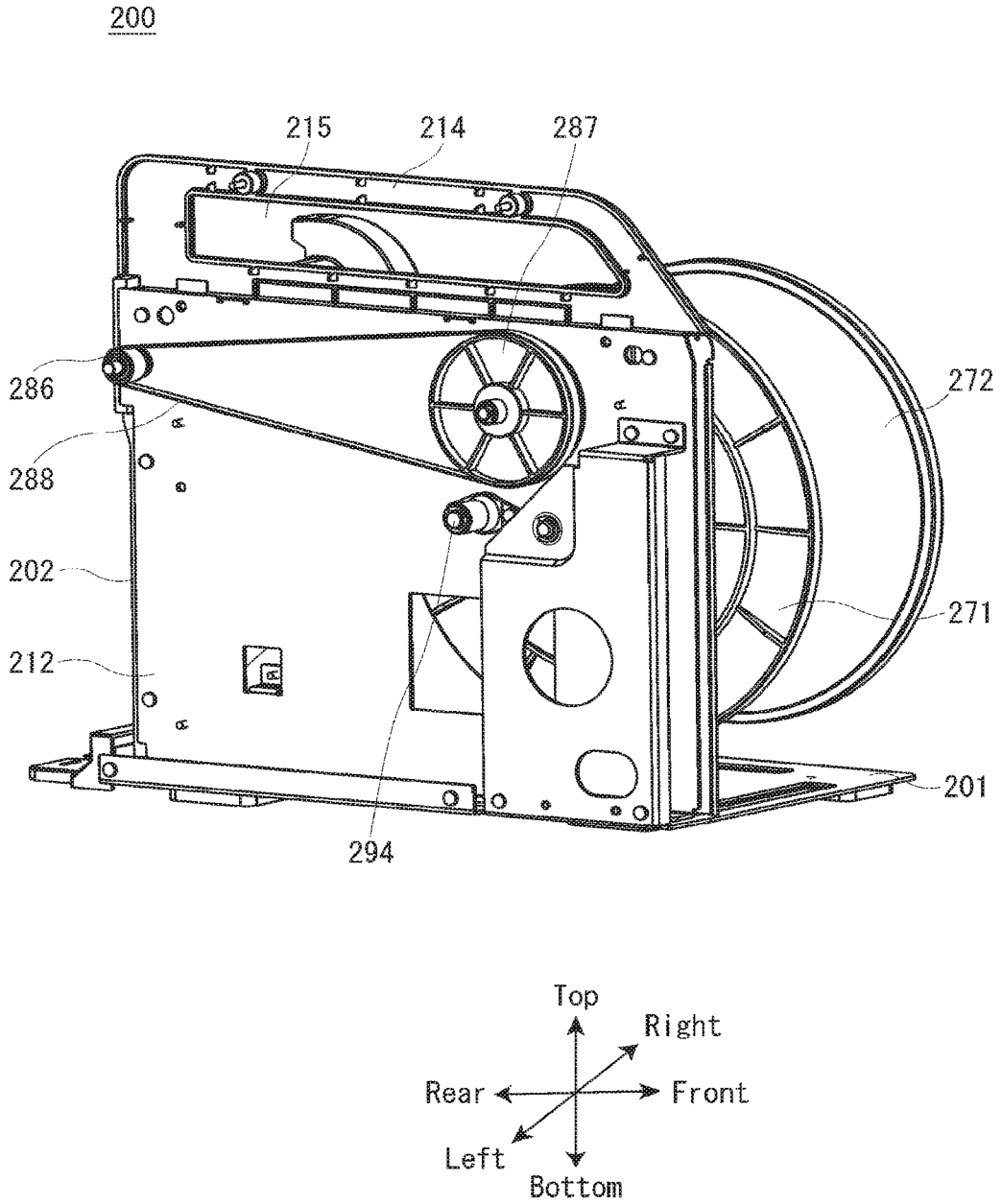
FIG. 7 is an external oblique view of the winding device from a different angle than in FIG. 6.
Figure 8:
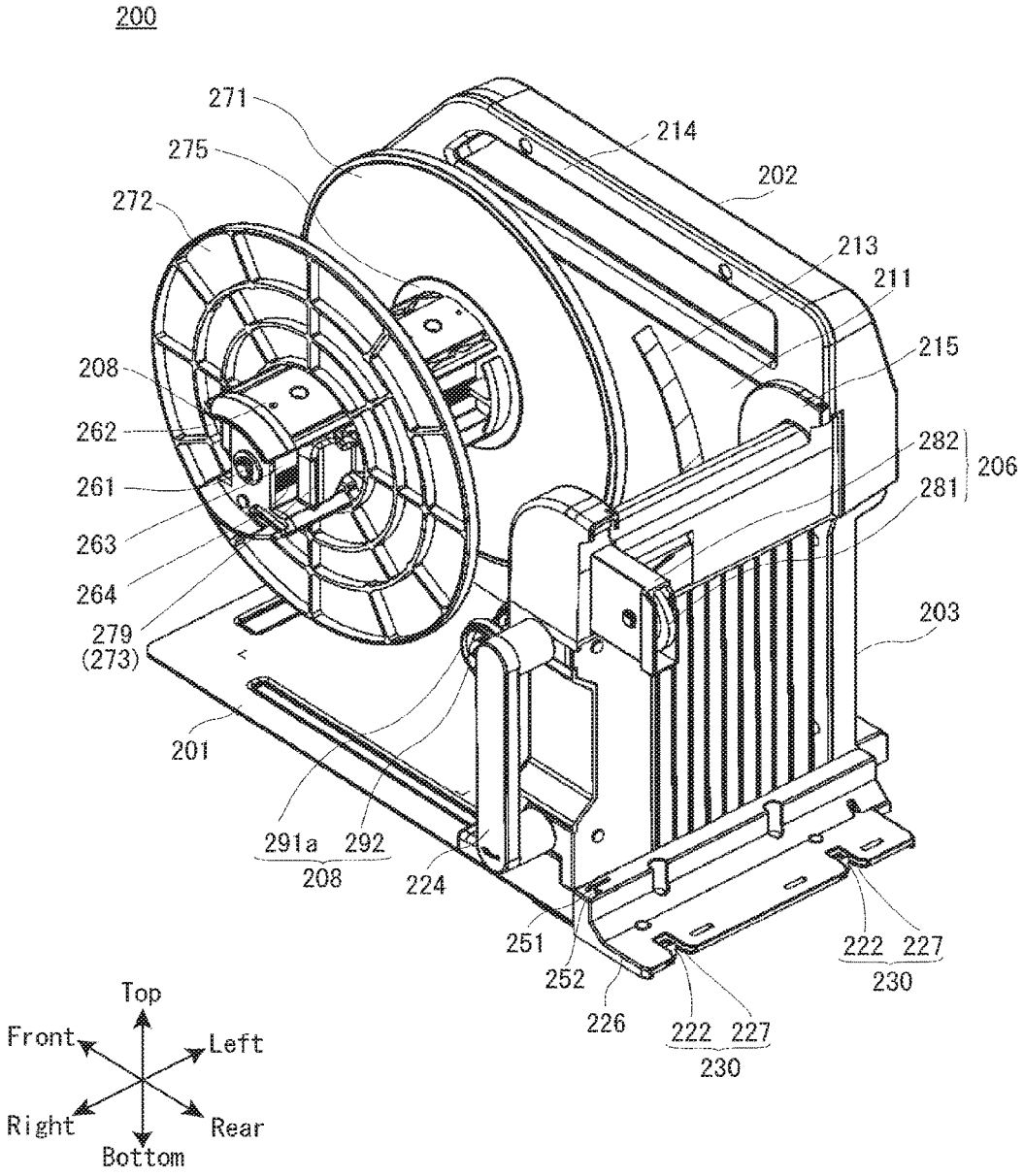
FIG. 8 is an external oblique view of the winding device from a different angle than in FIG. 6.

The small pulley 286 and large pulley 287 are disposed on the outside side of the outside wall 212 of the winding support unit 202 (see FIG. 7). The winder-side second intermediate gear 289 is disposed between the outside wall 212 and the inside wall 211.

By disposing the torque limiter 290 between the large pulley 287 and winder-side second intermediate gear 289, the winding shaft 205 can be driven with a substantially constant winding torque.

Furthermore, by using a torque limiter 290, the conveyance speed of the roll paper S in the printer 100, and the winding speed of the roll paper S in the winding device 200, can be held substantially the same by the torque limiter 290 even while the diameter of the take-up roll R changes as winding progresses. More specifically the speed difference of the conveyance speed and the winding speed can be absorbed by the torque limiter 290.

Figure 6:
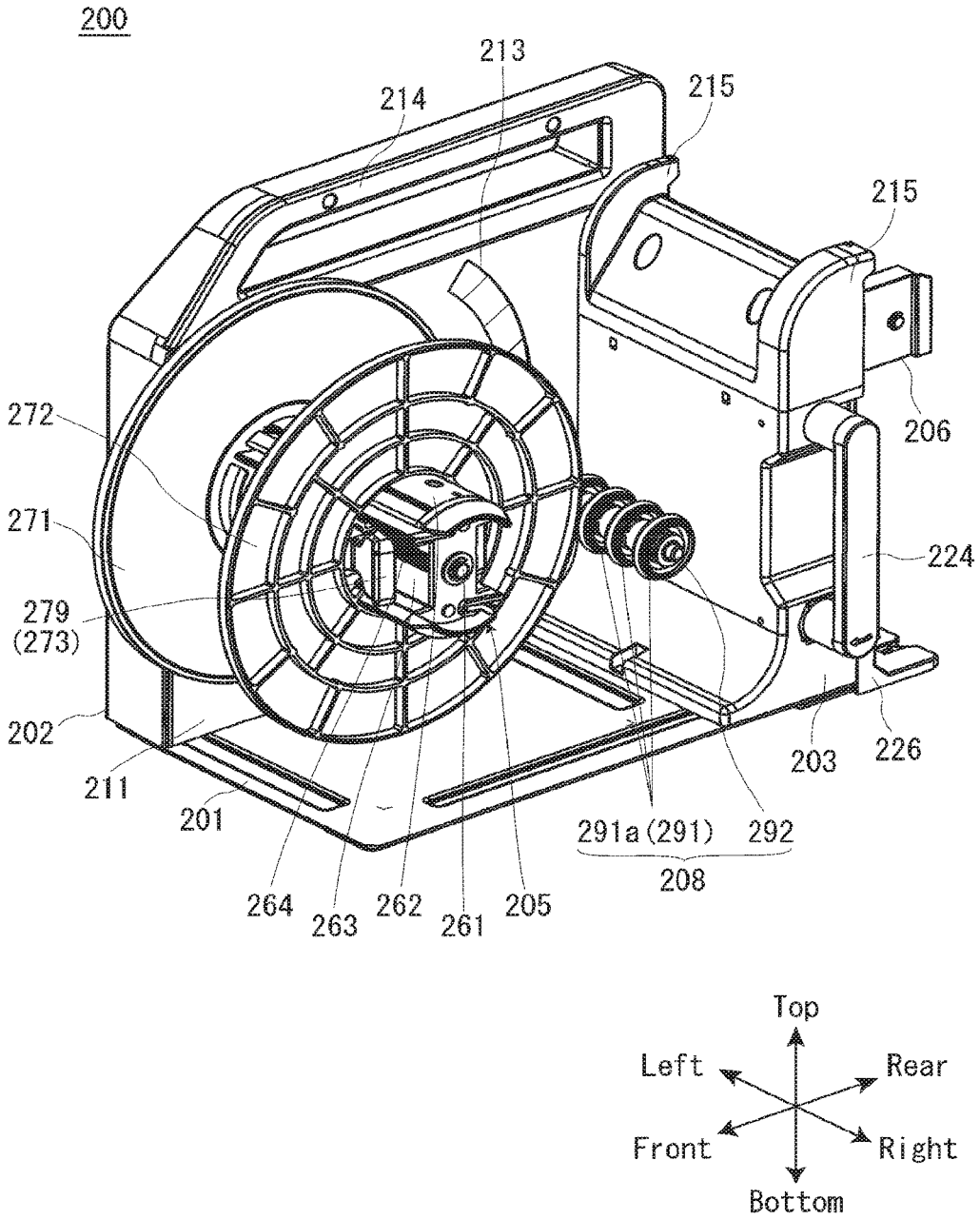
FIG. 6 is an external oblique view of the winding device.
Figure 9:
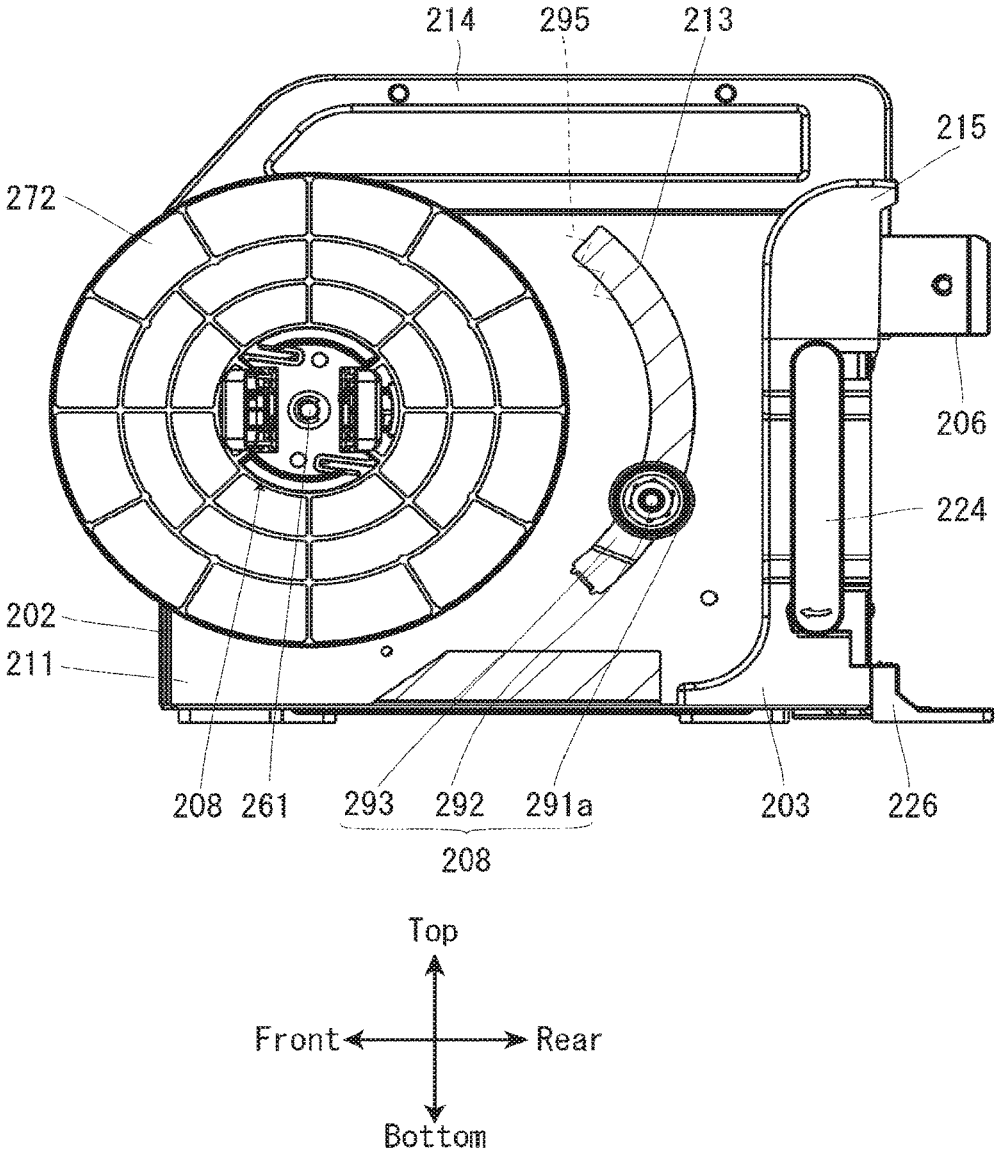
FIG. 9 is a right side view of the winding device.

As shown in FIG. 6 and FIG. 9, the lever 208 includes a roller 291, a roller spindle 292 that rotatably supports the roller 291, and a roller lever 293 that supports the roller spindle 292.

In this example, the roller 291 comprises six roller segments 291*a* distributed along the roller axis. Each of the roller segments 291*a* is a round rubber disc, for example. The six roller segments 291*a* rotate following conveyed roll paper S due to friction with the roll paper S. As a result, the printing surface of the roll paper S being worn by the lever 208 can be suppressed.

Furthermore, because the roller 291 comprises six roller segments 291*a*, the contact area between the lever 208 and the roll paper S is smaller, and the printing surface of the roll paper S being worn by the lever 208 can be more effectively suppressed. Damage to the printed image by the lever 208 can therefore be prevented. Note that any desirable number of roller segments 291*a* may be used, including two, but roll paper S of various widths can be handled by using more roller segments 291*a*. Note, further, that the gap between the plural roller segments 291*a* is preferably set according to the width of the roll paper S.

The left end of the roller spindle 292 passes through the roller travel slot 213 described above and is attached to the roller lever 293. The roller lever 293 is disposed between the inside wall 211 and the outside wall 212 of the winding support unit 202. The roller spindle 292 is attached to one end of the roller lever 293, and the other end is rotatably supported by the lever support shaft 294 (see FIG. 7) fastened to the outside wall 212.

A lever limiting member (not shown in the figure) that limits the downward rotational movement of the end of the roller lever 293, and an elastic member 295 (see FIG. 9) that limits the upward rotational movement of the end of the roller lever 293, are disposed between the inside wall 211 and the outside wall 212 of the winding support unit 202. Downward rotation of the end of the roller lever 293 is limited by the roller lever 293 meeting the lever limiting member when the roller lever 293 rotates down. The elastic member 295 is a coil compression spring, for example. Upward rotation of the roller lever 293 is limited by the roller lever 293 meeting the elastic member 295 as the roller lever 293 rotates up.

The lever 208 can rotate up and down between a first position P1 where the roller lever 293 meets the lever limiting member, and a second position P2 where the roller lever 293 meets the elastic member 295. More specifically, the lever 208 rotates between the first position P1 at which the roll paper S (FIGS. 15 (1) to (3)) bends, and the second position P2 (FIG. 15 (4)) where the roll paper S bends at a shallower angle than at the first position P1. The roller travel slot 213 is formed along the path the roller spindle 292 of the lever 208 moves when rotating between the first position P1 and the second position P2.

The lever 208 is normally positioned by its own weight at the first position P1 at the bottom end of its range of travel. More specifically, gravity works as the force urging the lever 208 to the first position P1. As a result, a spring or other means of applying force on the lever 208 to the first position P1 is not necessary. Note that a spring or other means of applying force on the lever 208 to the first position P1 may be used.

The action of the lever 208 when winding the roll paper S by the winding device 200 starts is described next with reference to FIG. 15. Before winding starts, that is, before driving the paper feed motor 116 starts, the lever 208 is at the first position P1 (FIG. 15 (1)).

When driving the paper feed motor 116 and winding starts, the conveyance speed of the roll paper S in the printer 100 quickly reaches the specific speed. The winding speed of the winding device 200, however, rises more slowly, particularly when the diameter of the take-up roll R is large, due to the inertia of the take-up roll R. As a result, the winding speed is slower than the conveyance speed when winding starts. Slack in the roll paper S therefore develops temporarily between the roll paper loading stand 203 and the winding shaft 205 (FIG. 15 (2)).

The winding speed then catches up to the conveyance speed and then the winding speed becomes faster than the conveyance speed. As a result, the slack in the roll paper S is gradually taken up. The winding speed is greatest at the moment the slack in the roll paper S disappears (see FIG. 15 (3)).

Figure 15:
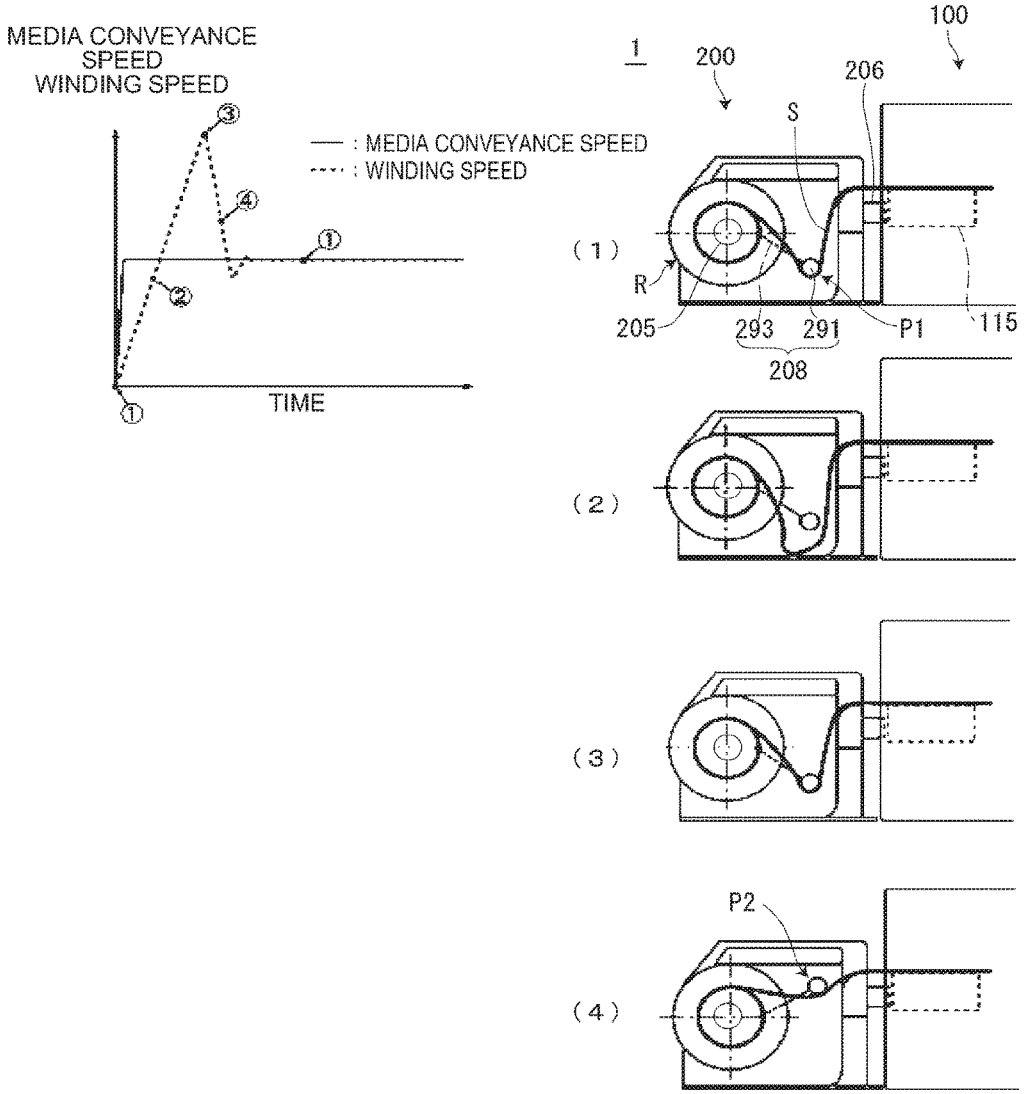
FIG. 15 illustrates the operation of the lever in the winding device.

Because the winding speed is high and the rotational energy of the take-up roll R is great immediately after the slack in the roll paper S disappears, the lever 208 is pushed up from the first position P1 to the second position P2 by the roll paper S with no slack (see FIG. 15 (4)). More specifically, the rotational energy of the take-up roll R is converted to the potential energy of the lever 208.

The lever 208 normally starts moving down at this time before reaching the second position P2, but may also reach the second position P2 when the diameter of the take-up roll R is large, for example. In this event, the roller lever 293 meets the elastic member 295 when the lever 208 is near the second position P2, and the elastic member 295 deforms elastically. As a result, the rotational energy of the take-up roll R can be absorbed by the elastic member 295 even when the rotational energy of the take-up roll R cannot be sufficiently absorbed by the lever 208 simply moving from the first position P1 to near the second position P2.

The winding speed then gradually slows, and the lever 208 returns to the first position P1 (FIG. 15 (1)) when the winding speed becomes substantially equal to the conveyance speed. The winding speed is then held substantially equal to the conveyance speed, and the roll paper S is wound by the winding shaft 205 with the lever 208 in the first position P1.

With the winding device 200 according to this embodiment of the invention as described above, when the winding speed gradually increases and temporarily exceeds the conveyance speed when winding starts, the lever 208 around which the roll paper S travels rises from the first position P1 to the second position P2 in resistance to the force of gravity pushing the lever 208 to the first position P1. The rotational energy of the take-up roll R is then converted to potential energy causing the lever 208 to rise from the first position P1 to the second position P2. More specifically, the rotational energy of the take-up roll R is absorbed by the lever 208 moving from the first position P1 to the second position P2. As a result, the rotational energy of the take-up roll R pulling the roll paper S to the winding device 200 side is suppressed. Therefore, adverse effects on the conveyance precision of the roll paper S in the printer 100 can be prevented. As a result, printed images that are desirably printed can be achieved by the print winding system 1 according to this embodiment of the invention.

Furthermore, the winding device 200 is desirably positioned when installed to the printer 100 by the positioning mechanism 204 described above. However, even if the installation position of the winding device 200 varies slightly, skewing of the roll paper S in the printer 100 can be suppressed because the roll paper S travels around the lever 208. More specifically, deviation in the installation position can be alleviated by the bent portion of the roll paper S.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A winding device attachable to a printing device having a conveyance roller configured to convey a print medium from a printing device and a motor, the winding device comprising;

a winding shaft configured to rotate and wind the print medium conveyed from the printing device;

a power transfer mechanism configured to connect to the gear and transfer power from the motor to the winding shaft; and a lever disposed between the winding shaft and the conveyance roller in a conveyance path when the winding device is connected to the printing device, wherein the lever is configured to move between a first position in which the print medium bends at a first angle and a second position in which the print medium bends at a second angle that is larger than the first angle.

2. The winding device described in claim 1, wherein:

the power transfer mechanism includes an input gear that is connected to the gear, the input gear being configured to move relative to the gear.

3. The winding device described in claim 2, wherein:

the input gear is inserted in an input unit insertion recess of the printing device; and an input support unit rockably supports the input gear.

4. The winding device described in claim 1, wherein:

the first position is lower than the second position.

5. The winding device described in claim 1, further comprising:

an elastic member that the lever contacts when the lever is at or near the second position.

6. The winding device described in claim 1, wherein:

the lever comprises a roller.

7. The winding device described in claim 6, wherein:

the roller includes a plurality of roller segments distributed in an axial direction.

8. The winding device described in claim 6, wherein:

the lever further comprises a roller lever that supports the lever and is configured to rotate on a pivot point.

9. The winding device described in claim 1, wherein:

the power transfer mechanism includes a torque limiter.

* * * * *